US006955728B1

(12) United States Patent
van Ooij et al.

(10) Patent No.: US 6,955,728 B1
(45) **Date of Patent: *Oct. 18, 2005**

(54) ACYLOXY SILANE TREATMENTS FOR METALS

(75) Inventors: Wim J. van Ooij, Fairfield, OH (US); Danqing Zhu, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 397 days.

This patent is subject to a terminal disclaimer.

(21) Appl. No.: 10/031,731

(22) PCT Filed: Jul. 19, 2000

(86) PCT No.: PCT/US00/19646

§ 371 (c)(1),
(2), (4) Date: Jun. 6, 2002

(87) PCT Pub. No.: WO01/06036

PCT Pub. Date: Jan. 25, 2001

Related U.S. Application Data

(63) Continuation-in-part of application No. PCT/EP00/06794, filed on Jul. 17, 2000, and a continuation-in-part of application No. 09/356,926, filed on Jul. 19, 1999, now Pat. No. 6,827,981.

(51) Int. Cl.[7] ..... B05D 3/00
(52) U.S. Cl. ..... 148/240; 427/387; 427/409; 428/450; 428/447
(58) Field of Search ..... 148/240; 428/450, 428/447; 427/409, 387

(56) References Cited

U.S. PATENT DOCUMENTS 2,751,314 A 6/1956 Keil
3,022,196 A 5/1962 Jenkins et al.
3,246,671 A 4/1966 Stein et al.
3,476,826 A 11/1969 Millen
3,816,152 A 6/1974 Yates
3,842,111 A 10/1974 Meyer-Simmon et al.
3,873,334 A 3/1975 Lee et al.
3,879,206 A 4/1975 Nestler et al.
3,960,800 A 6/1976 Kohl, Jr.
4,000,347 A 12/1976 Ranney et al.
4,015,044 A 3/1977 Ranney et al.
4,059,473 A 11/1977 Okami
4,064,313 A 12/1977 Takiguchi et al.
4,151,157 A 4/1979 Williams et al.
4,152,347 A 5/1979 Pletka et al.
4,179,537 A 12/1979 Rykowski
4,210,459 A 7/1980 Williams et al.
4,231,910 A 11/1980 Plueddemann
4,243,718 A 1/1981 Murai et al.

(Continued)

FOREIGN PATENT DOCUMENTS

CA 2110461 7/1994

(Continued)

OTHER PUBLICATIONS

Buchwalter, L.P., et al. Adhesion of polyimides to ceramics: Effects of aminopropyltriethoxysilane and temperature and humidity exposure on adhesion, *J. Adhesions Sci. Technol.*, vol. 5, No. 4, pp. 333-343 (Dec. 1991).

(Continued)

*Primary Examiner*—Scott Kastler
(74) *Attorney, Agent, or Firm*—Dinsmore & Shohl LLP

(57) ABSTRACT

A method of treating a metal surface by application of a solution containing at least one acyloxy silane and at least one basic compound. A composition having at least one acyloxy silane and at least one basic compound is also provided, along with a silane coated metal surface.

38 Claims, 5 Drawing Sheets

A1170/VTAS Mix. Treated AA5005 after 29 days of SST (a) Blank; (b) Chroamted; (c ) A1170/VTAS treated*

* A1170/VTAS: 1.5/1, natural pH=4

U.S. PATENT DOCUMENTS

| | | | | |
|---|---|---|---|---|
| 4,315,970 | A | 2/1982 | McGee | |
| 4,401,500 | A | 8/1983 | Hamada et al. | |
| 4,409,266 | A | 10/1983 | Wieczorrek et al. | |
| 4,441,946 | A | 4/1984 | Sharma | |
| 4,457,970 | A | 7/1984 | Das et al. | |
| 4,461,867 | A | 7/1984 | Surprenant | |
| 4,489,191 | A | 12/1984 | Chung | |
| 4,534,815 | A | 8/1985 | Hamada et al. | |
| 4,618,389 | A | 10/1986 | Agodoa | |
| 4,681,636 | A | 7/1987 | Saito et al. | |
| 4,719,262 | A | 1/1988 | Plueddemann | |
| 4,863,794 | A | 9/1989 | Fujii et al. | |
| 5,051,129 | A | 9/1991 | Cuthbert et al. | |
| 5,073,195 | A | 12/1991 | Cuthbert et al. | |
| 5,073,456 | A | 12/1991 | Palladino | |
| 5,108,793 | A | 4/1992 | van Ooij et al. | |
| 5,203,975 | A | 4/1993 | Richardson | |
| 5,217,751 | A | 6/1993 | King et al. | |
| 5,221,371 | A | 6/1993 | Miller | |
| 5,292,549 | A | 3/1994 | van Ooij et al. | |
| 5,322,713 | A | 6/1994 | van Ooij et al. | |
| RE34,675 | E | 7/1994 | Plueddemann | |
| 5,326,594 | A | 7/1994 | Sabata et al. | |
| 5,363,994 | A | 11/1994 | Angeline | |
| 5,389,405 | A | 2/1995 | Purnell et al. | |
| 5,393,353 | A | 2/1995 | Bishop | |
| 5,405,985 | A | 4/1995 | Parker et al. | |
| 5,412,011 | A | 5/1995 | Morris et al. | |
| 5,433,976 | A | 7/1995 | van Ooij et al. | |
| 5,455,080 | A | 10/1995 | van Ooij et al. | |
| 5,466,848 | A | 11/1995 | Childress | |
| 5,468,893 | A | 11/1995 | Parker et al. | |
| 5,520,768 | A | 5/1996 | Crook et al. | |
| 5,603,818 | A | 2/1997 | Brent et al. | |
| 5,622,782 | A | 4/1997 | Poutasse, III et al. | |
| 5,633,038 | A | 5/1997 | Ruschau | |
| 5,639,555 | A | 6/1997 | Bishop | |
| 5,660,884 | A | 8/1997 | Crook et al. | |
| 5,700,523 | A | 12/1997 | Petrole et al. | |
| 5,750,197 | A | 5/1998 | van Ooij et al. | |
| 5,759,629 | A | 6/1998 | van Ooij et al. | |
| 5,789,080 | A | 8/1998 | Grimberg et al. | |
| 5,851,371 | A | 12/1998 | Steinbrecher et al. | |
| 5,907,015 | A | 5/1999 | Sexsmith | |
| 6,057,040 | A | 5/2000 | Hage | |
| 6,071,566 | A | 6/2000 | Brown et al. | |
| 6,132,808 | A | 10/2000 | Brown et al. | |
| 6,416,869 | B1 * | 7/2002 | van Ooij et al. | 428/450 |
| 6,756,079 | B2 * | 6/2004 | van Ooij et al. | 427/409 |
| 6,827,981 | B2 * | 12/2004 | van Ooij et al. | 427/387 |

FOREIGN PATENT DOCUMENTS

| | | | |
|---|---|---|---|
| DE | 3443926 | A1 | 6/1986 |
| EP | 0435781 | A2 | 7/1991 |
| EP | 0533606 | A1 | 3/1993 |
| EP | 0579253 | B1 | 1/1994 |
| JP | 533076 | | 2/1978 |
| JP | 5852036 | | 11/1981 |
| JP | 56161475 | | 12/1981 |
| JP | 6081256 | | 5/1985 |
| JP | 60208480 | | 10/1985 |
| JP | 60213902 | | 10/1985 |
| JP | 627538 | | 1/1987 |
| JP | 6257470 | | 3/1987 |
| JP | 6397266 | | 4/1988 |
| JP | 6397267 | | 4/1988 |
| JP | 6334793 | | 7/1988 |
| JP | 533275 | | 5/1993 |
| JP | 6184792 | | 7/1994 |
| WO | WO 9830735 | | 7/1998 |
| WO | WO9920682 | | 4/1999 |
| WO | WO 9920705 | | 4/1999 |
| WO | WO 9967444 | | 12/1999 |
| WO | WO 0038844 | | 7/2000 |

OTHER PUBLICATIONS

Cruse, R. W., et al., Effect of Polysulfidic Silane Sulfur on Rolling Resistance, *Rubber & Plastic News* ,pp. 14-17 (Apr. 21, 1997).

Henriksen, P.N., et al. Inelastic electron tunneling spectroscopic studies of alkoxysilanes adsorbed on alumina, *J. Adhesion Sci. Technol.,* vol. 5, No. 4, pp. 312-331 (Dec. 1991).

Homstrom, S.E., et al., Paint Adhesion and Corrosion Performance of Chromium-Free Pretreatment of 55% Al-Zn-coated Steel, *J. Adhesion Sci. Technol.* vol. 10, No. 9, pps. 883-904 (Dec. 1996).

Homstrom, S.E., et al., Characterization of Thin Films of Organofunctional and Non-Fuctional Silanes on 55A1-43, 4Zn-1.6Si Alloy Coated Steel, *ECASIA 97*, pp. 987-990 (Dec. 1997).

Lunginsland, H. D., Reactivity of the Sulfur Functions of the Disulfane Silane TESPD and the Tetrasulfane Silane TESPT, presented at a meeting of the Rubber Division, American Chemical Society, Chicago, Illinois (Apr. 13-16, 1999).

Plueddemann, Edwin P., Silane primers for epoxy adhesives, *J. Adhesion Sci. Technol.,* vol. 2, No. 3, pp. 179-188 (Dec. 1988).

Plueddemann, Edwin P., Reminiscing on Silane Coupling Agents, *J. Adhesion Sci. Technol.* vol. 5, No. 4, pp. 261-277 (Dec. 1991).

Plueddemann, Edwin P., et al. Adhesion Enhancing Additives for Silane Coupling Agents, 42nd Annual Conference, Composites Institute, The Society of the Plastic Industry, Inc., (Feb. 2-6, 1987).

Pu, Z., et al., Hydrolysis Kinetics and Stability of Bis (Triethoxysilyl) Ethane in Water-Ethanol Solution by FTIR Spectroscopy, *Journal of Adhesion Science and Technology* (Dec. 1996).

Sabata, A., et al., Trends toward a better understanding of the interface in painted metals, *Trends in Corrosion Research,* 1, pp. 181-193 (Dec. 1993).

Sabata, A., et al., The interphase in painted metals pretreated by functional silanes, *J. Adhesion Sci. Technol.,* vol. 7, No. 11, pp. 1153-1170 (Dec. 1993).

Sabata, A. Et al., TOFSIMS Studies of Cleaning Procedures and Silane Surface Treatments if Steels, *Journal of Testing and Evaluation,* JTRVA, vol. 23, No. 2, pp. 119-125 (Mar. 1995).

van Ooij. W. J., et al. Characterization of Films of Organofunctional Silanes by ToF-SIMS, *Surface and Interface Analysis,* vol. 20, pp. 475-484 (1993).

van Ooij, W. J., et al. Modifications of the Interface Between Paints and Stainless Steels by Means of an Interphase Crosslinked Organofunctional, Materials Research Society Symposium Proceedings, vol. 304, pp. 155-160, (Dec. 1993).

van Ooij, W. J., et al. Novel Silane-Based Pretreatments of Metals to Replace Chromate and Phosphate Treatment, *2nd Annual Advaced Tecniques for Replacing Chromium: An Information Exchange,* prepared by David S. Viszlay, Concurrent Technologies Corp. NDCEE, Seven Springs Mountain Resort, Champion, PA (Nov. 7-8, 1995) pp. 287-310.

van Ooij, W. J., et al. On the Use, Characterization and Performance of Silane Coupling Agents Between Organic Coatings and Metallic or ceramic Substrates, *American Institute of Physics,* pp. 305-321 (Dec. 1996).

van Ooij W. J., et al., Silane-Based Pretreatments of A1 and its Alloys as Chromate Alternatives, Aluminium Surface Science Technology, "Elzenveld" Antwerp-Belgium, (May 12-15, 1997).
van Ooij, W. J. et al., Silane Coupling Agent Treatments of Metals for Corrosion Protection, Presented at the Fourth Interantional Forum and business Development Conference on Surface Modification, Couplants and Adhesion Promoters, Adhesion Coupling Agent Technology 97, Boston, MA (Sep. 22-24, 1997).
van Ooij, W. J., et al., Pretreatment of Metals for Painting by Organofunctional Silanes, Extended Abstract of Paper Presented at 1997 International Symposium on Advances in Corrosion Protection by Organic Coatings, Noda, Japan (Oct. 29-31, 1997).
van Ooij, W. J., et al., Rubber to Metal Bonding, Presented at the International Conference on rubbers, Calcutta, India (Dec. 12-14, 1997).
van Ooij., W.J., et al., Bonding Rubber to Metals by Silanes, Presented at Rubber Division, American Chemical Chemical Society 155th Technical Meeting, Chicago, IL., (Apr. 13-16, 1999).
Walker, P., Organosilanes as adhesion promoters, *J. Adhesion Sci. Technol.* vol. 5, No. 4, pp. 279-305 (Dec. 1991).
Wu, G. L. Et al. Alcoholysis of Chlorosilanes and the Synthesis of Silance Coupling Agents, Inst. Chem., Adad. Sin., Peking, People Rep. China, Hua Hsueh Hsueh Pao (Dec. 1980) (Abstract Only).
Yuan, W., et al., Characterization of Organofuctional Silane Films on Zinc Substrates, Submitted to *Journal of Colloid and Interface Science,* (Aug. 30, 1996).
Zhang, B. C., et al., Charterization of Silane Films Deposited on Iron Surfaces, Submitted to Langmuir, First Revision, (May 3, 1996).
Abstract of Japanese patent No. 62-79732 (Oct. 4, 1994).
Abstract of Japanese patent No. 41-6174 (Apr. 8, 1992).
Abstract of Japanese patent No. 62-216727 (Sep. 24, 1987).
Abstract of Japanese patent No. 40-46932 (Feb. 17, 1972).
Comyn, J., et al., An examination of the interaction of silanes containig carbon-carbon double bonds with aluminum oxide by inelastic electron tunneling spectroscopy, *Int. J. Adhesion* (1990), 10(1), 13-18 (abstract only).
Kurth, D.G., et al., Monomolecular layers and thin films of silane coupling agents by vapor-p[hase adsorption on oxidized aluminum, *J. Phys. Chem* (1992), 96(16), 6707-12 abstract only.
van Ooij, W. J., Silane-based Metal Pretreatments to Replace Phosphates and Chromates; copy of overhead slides presented at the 3rd Annual Advanced Techniques for Replacing Chromium: An Information Exchange and Technology Demonstration, Nov. 4-6, 1996.
Abstract of Japanese patent No. 59-185779 (Oct. 22, 1984).
Abstract of Japanese patent No. 07-329104 (Dec. 19, 1995).
Abstract of Japanese patenet No. 62-83034 (Apr. 16, 1987).
Abstract of Japanese patent No. 53-232 (Jan. 5, 1978).

* cited by examiner

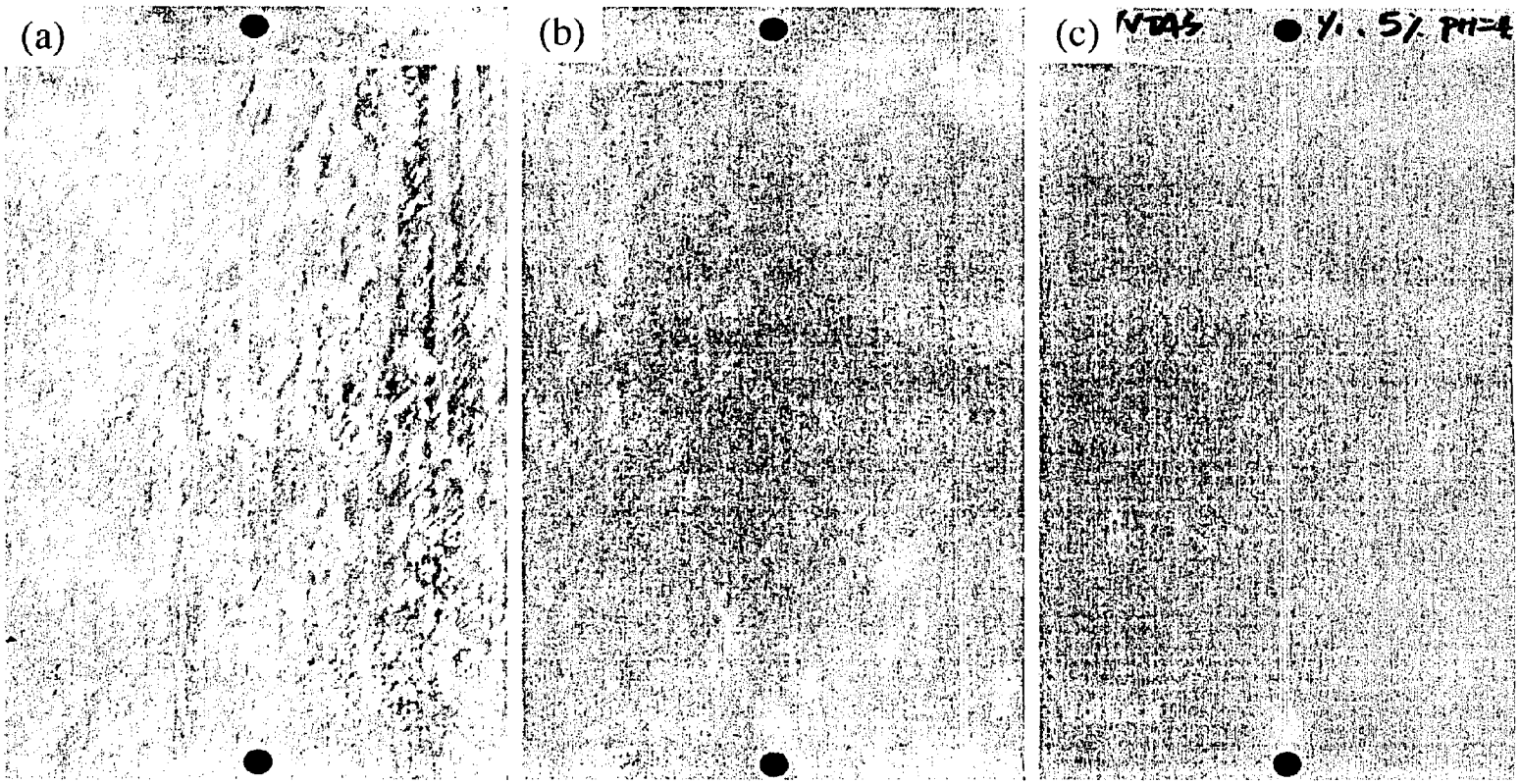
Fig.1. A1170/VTAS Mix. Treated AA5005 after 29 days of SST
(a) Blank; (b) Chroamted; (c ) A1170/VTAS treated*
* A1170/VTAS: 1.5/1, natural pH=4

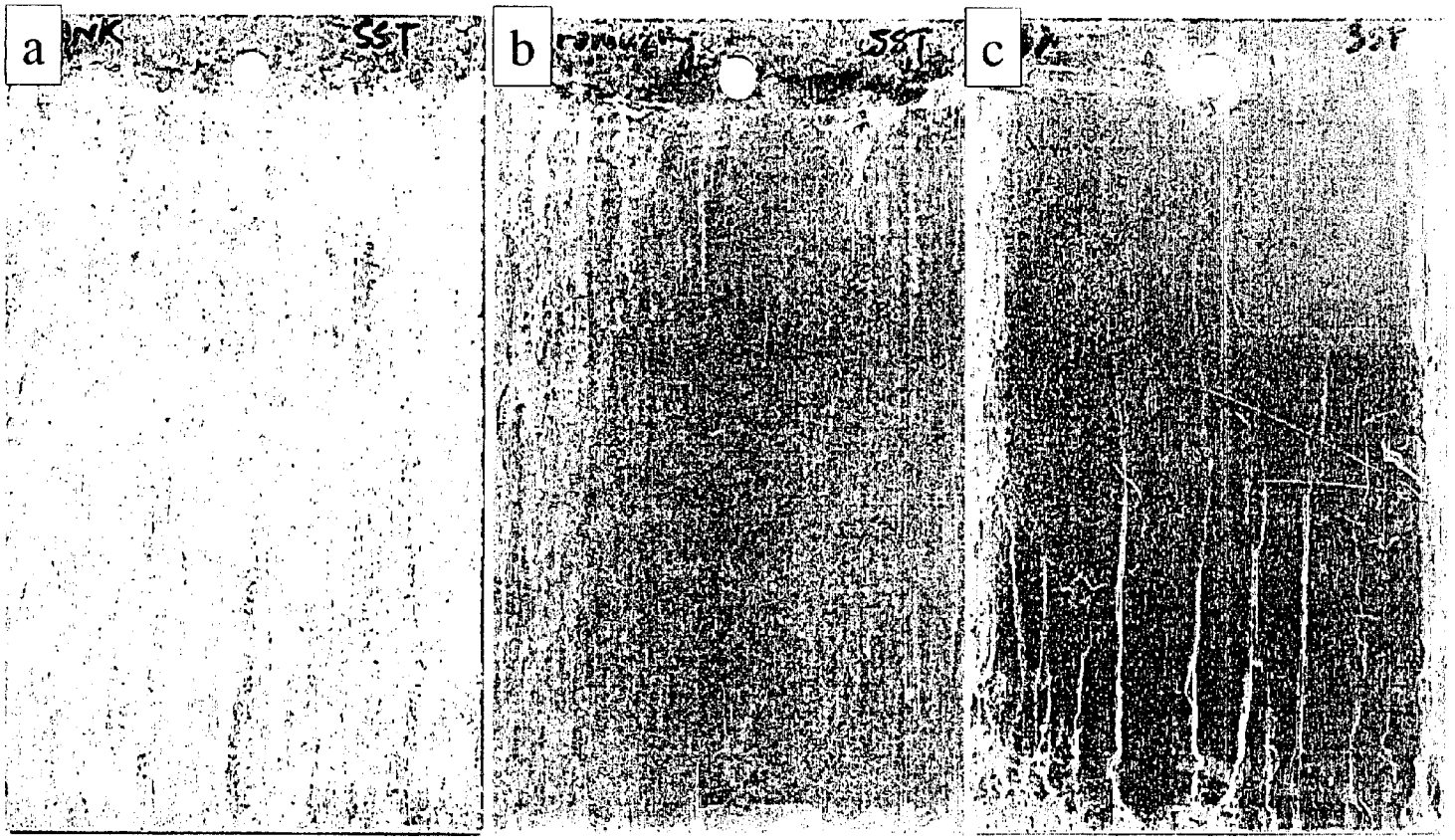
Fig. 2. A1170/VTAS Mix. treated Al2024-T3 after 7days of SST
(a) Blank; (b) Chromated; (c ) A1170/VTAS treated
* A1170/VTAS: 1.5/1, 5%, natural pH=4

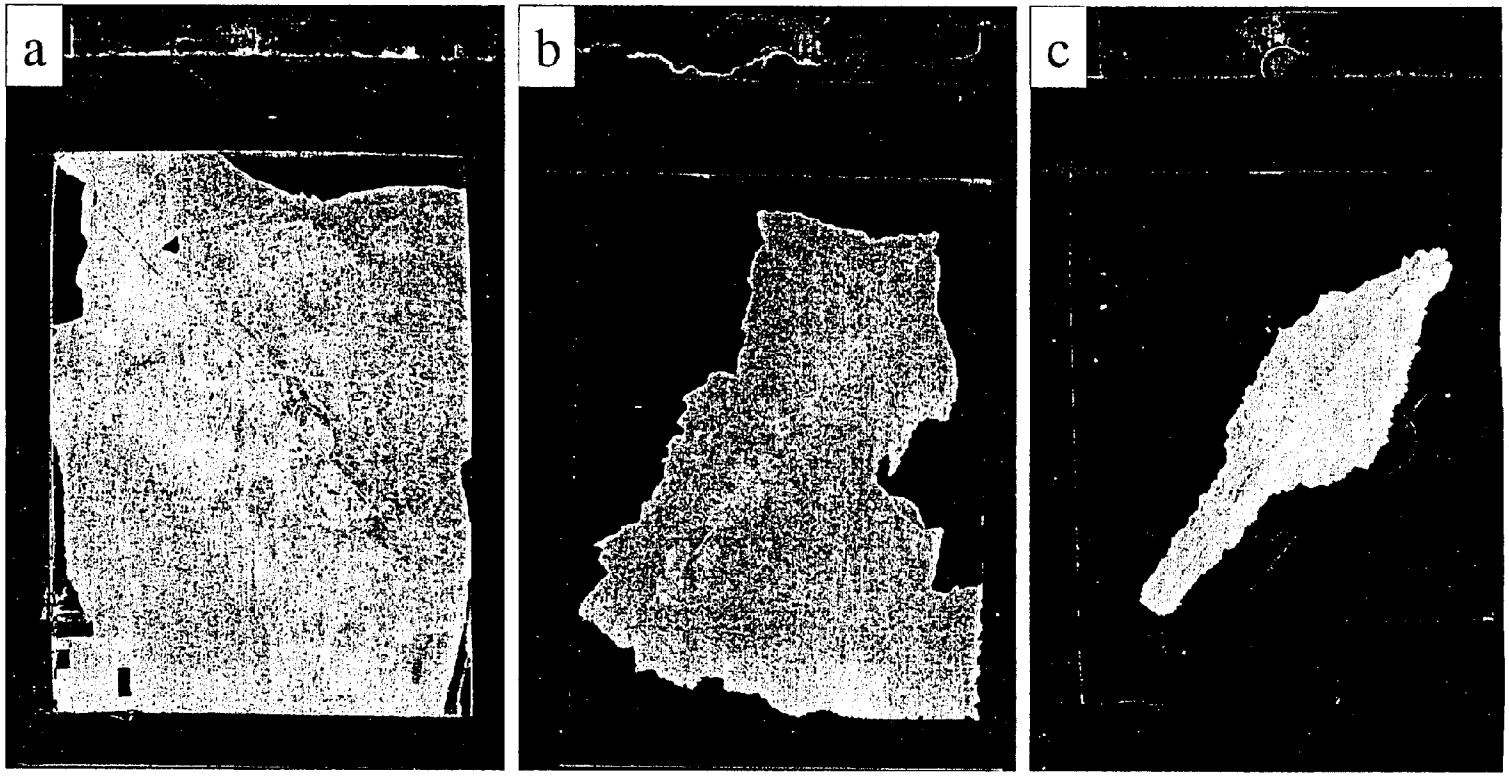
Fig. 3a Polyester powder painted HDG after 336 hrs of SST
(a) Blank; (b) Chromated; (c ) A1170/VTAS treated
* A1170/VTAS: 1.5/1, 2%, natural pH=5

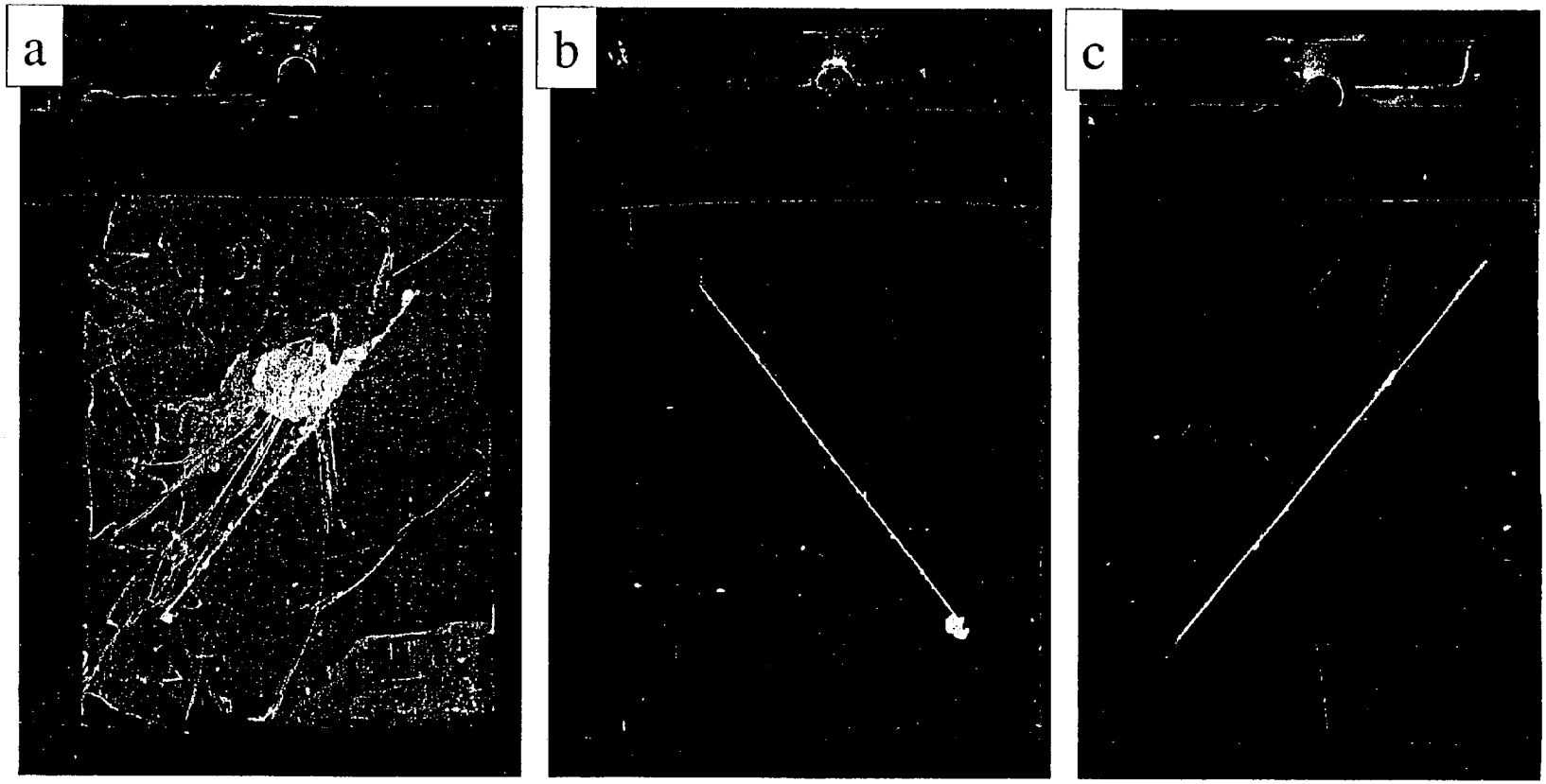
Fig. 3b. Polyester powder painted Al2024-T3 after 1000 hrs of SST
(a) Blank; (b) Chromated; (c ) A1170/VTAS treated
* A1170/VTAS: 1.5/1, 2%, natural pH=5

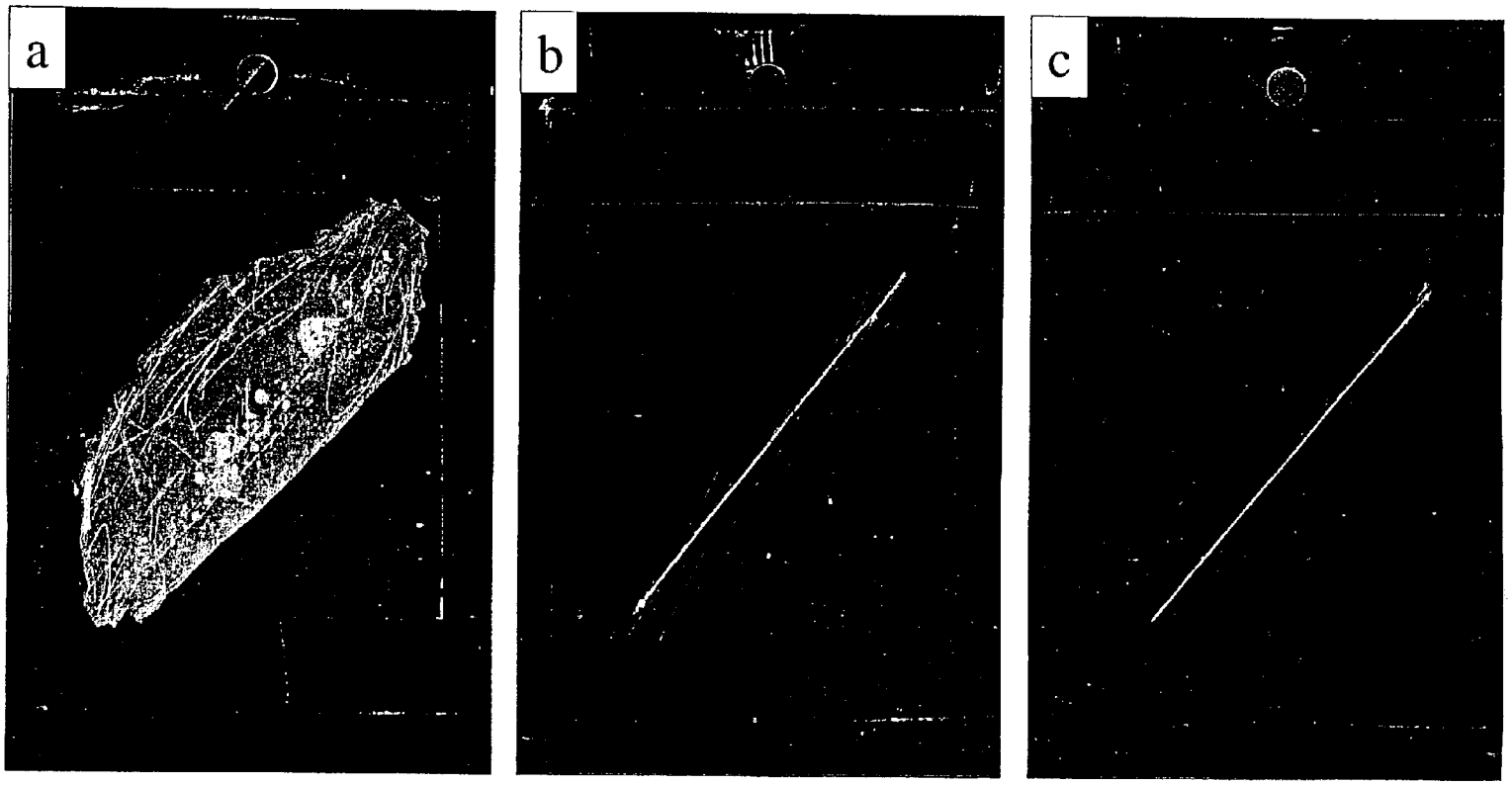
Fig. 3c Polyurethane powder painted Al2024 after 1000 hrs of SST
(a) Blank; (b) Chromated; (c ) A1170/VTAS treated
* A1170/VTAS: 1.5/1, 2%, natural pH=5

ACYLOXY SILANE TREATMENTS FOR METALS

This application is a continuation-in-part, and claims the benefit under 35 U.S.C. § 120 of U.S. patent application Ser. No. 09/356,926 now U.S. Pat. No. 6,827,981 B2, filed Jul. 19, 1999. This application is also a continuation-in-part, and claims the benefit under 35 U.S.C. §§ 120 and 365(c) of International Application no. PCT/EP00/06794, filed Jul. 17, 2000.

BACKGROUND OF THE INVENTION

1. Field of the Invention

The present invention relates to silane coatings for metals. More particularly, the present invention provides coatings which include an acyloxy silane, and are particularly useful for preventing corrosion and/or promoting adhesion between a metal substrate and a polymer layer applied to the treated metal substrate. Solutions for applying such coatings, compositions as well as methods of treating metal surfaces, are also provided.

2. Description of the Related Art

Most metals are susceptible to corrosion, including the formation of various types of rust. Such corrosion will significantly affect the quality of such metals, as well as that of the products produced therefrom. Although rust and the like may often be removed, such steps are costly and may further diminish the strength of the metal. In addition, when polymer coatings such as paints, adhesives or rubbers are applied to the metals, corrosion may cause a loss of adhesion between the polymer coating and the metal.

By way of example, metallic coated steel sheet such as galvanized steel is used in many industries, including the automotive, construction and appliance industries. In most cases, the galvanized steel is painted or otherwise coated with a polymer layer to achieve a durable and aesthetically-pleasing product. Galvanized steel, particularly hot-dipped galvanized steel, however, often develops "white rust" during storage and shipment.

White rust (also called "wet-storage stain") is typically caused by moisture condensation on the surface of galvanized steel which reacts with the zinc coating. On products such as GALVALUME®, the wet-storage stain is black in color ("black rust"). White rust (as well as black rust) is aesthetically unappealing and impairs the ability of the galvanized steel to be painted or otherwise coated with a polymer. Thus, prior to such coating, the surface of the galvanized steel must be pretreated in order to remove the white rust and prevent its reformation beneath the polymer layer. Various methods are currently employed to not only prevent the formation of white rust during shipment and storage, but also to prevent the formation of white rust beneath a polymer coating (e.g., paint).

In order to prevent white rust on hot-dipped galvanized steel during storage and snipping, the surface of the steel is often passivated by forming a thin chromate film on the surface of the steel. While such chromate coatings do provide resistance to the formation of white rust, chromium is highly toxic and environmentally undesirable. It is also known to employ a phosphate conversion coating in conjunction with a chromate rinse in order to improve paint adherence and provide corrosion protection. It is believed that the chromate rinse covers the pores in the phosphate coating, thereby improving the corrosion resistance and adhesion performance. Once again, however, it is highly desirable to eliminate the use of chromate altogether. Unfortunately, however, the phosphate conversion coating is generally not very effective without the chromate rinse.

Recently, various techniques for eliminating the use of chromate have been proposed. These include coating the galvanized steel with an inorganic silicate followed by treating the silicate coating with an organofunctional silane (U.S. Pat. No. 5,108,793).

U.S. Pat. No. 5,292,549 teaches the rinsing of metallic coated steel sheet with a solution containing an organofunctional silane and a crosslinking agent.

U.S. Pat. No. 6,071,566 relates to a method of treating a metal substrate to provide permanent corrosion resistance. The method comprises applying a solution containing one or more vinyl silanes in admixture with one or more multi-silyl-functional silanes to a metal substrate in order to form a coating.

Various other techniques for preventing the formation of white rust on galvanized steel, as well as preventing corrosion on other types of metals, have also been proposed. Many of the proposed techniques described in the prior art are, however, ineffective, or require time-consuming, energy-inefficient, multistep processes. Thus, there is a need for a simple, low-cost technique for preventing corrosion on the surface of metal.

A particular problem associated with the silane treatments of the prior art is the rate of hydrolysis of the silane compounds. Such compounds are generally hydrolysed in water, at a specific pH, prior to application of the solution to the substrate to be treated. The rate of hydrolysis varies between silanes, and the degree of hydrolysis is a priori not known. Generally, it has to be guessed when the solution is ready for application. When the solution has turned cloudy, this indicates that condensation of the silanes has occurred and the effectiveness of the treatment solution is reduced.

A further problem with the prior art techniques is the inherent insolubility in aqueous media of some of the silanes employed in the metal treatments. To overcome this problem it is commonplace to dissolve the silane with the aid of an organic solvent, for example, alcohols. Thus a final treatment solution commonly contains up to 60% alcohol. The use of many volatile organic compounds (VOCs), including solvents, is highly undesirable from an economic, as well as an environmental perspective. Apart from the cost of such organic solvents, including the cost of their disposal and methods of treatment solution preparation, such compounds present a threat to the environment and are a hazzard to the premises and personnel handling the materials.

A further problem is that the silane systems used in treatment solutions have to have their pH maintained in specific ranges by the initial and continuous addition of acids or bases.

It would therefore be desirable to provide an effective treatment method for metal surfaces, especially to prevent corrosion, and/or improve adhesion.

It would also be desirable to provide a treatment solution useful in preventing corrosion, and/or adhesion promotion of metal surfaces, for example, steel, aluminium, aluminium alloys, zinc, zinc alloys, magnesium, magnesium alloys, copper, copper alloys, tin and tin alloys, particularly zinc, zinc alloys, and other metals having a zinc-containing coating thereon.

It would additionally be desirable to provide a metal surface having improved corrosion resistance and/or improved adhesion characteristics.

SUMMARY OF THE INVENTION

The present invention provides a method of treating a metal surface, comprising the steps of;

(a) providing a metal substrate; and (b) applying a solution to said metal substrate, said solution comprising (i) at least one acyloxy silane which comprises at least one acyloxy group, wherein said silane has been at least partially hydrolysed; and (ii) at least one basic compound;

wherein the acyloxy silane and the basic compound are present in concentrations to provide a solution pH of between about 3 and about 10, more preferably between about 4 and about 8, most preferably 4 to 5 and wherein the solution is substantially free of acid other than acid produced upon hydrolysis of the acyloxy silane.

The present invention also provides a composition comprising at least one acyloxy silane and at least one basic compound, wherein the at least one acyloxy silane is at least partially hydrolyzed. A metal surface having improved corrosion resistance and/or adhesion and a composition concentrate is also provided.

DETAILED DESCRIPTION OF THE INVENTION

The acyloxy silane(s) utilised in the present invention may comprise one or more silyl groups and the solution may contain a mixture of acyloxy silanes.

Where the acyloxy silane comprises a single silyl group the silicon atom is tetrasubstituted, wherein the substituents are individually selected from the group consisting of alkyl, alkenyl, alkynyl, aryl, alkaryl, aralkyl, vinyl, amino, ureido, glycidoxy, epoxy, hydroxy, alkoxy, aryloxy and acyloxy, or any of the group alkyl, alkenyl, alkynyl, aryl, alkaryl and aralkyl substituted by a group selected from the group consisting of vinyl, amine, ureido, glycidoxy, epoxy, hydroxy and alkoxy, with the proviso that at least one of the substituents on the silicon atom is an acyloxy group.

Where more than one acyloxy group is attached to the silicon atom of the silyl group, the acyloxy groups are preferably all the same. The acyloxy group(s) are preferably selected from the group consisting of $C_{2-12}$ alkanoyloxy, $C_{3-12}$ alkenoyloxy, $C_{3-12}$ alkynoyloxy and $C_{7-18}$ arenoyloxy, preferably $C_{2-6}$ alkanoyloxy, $C_{3-6}$ alkenoyloxy, $C_{3-6}$ alkynoyloxy and $C_{7-12}$ arenoyloxy. Most preferably the acyloxy groups are all the same and are ethanoyloxy (acetoxy) or methanoyloxy groups.

Where the acyloxy silane comprises a single silyl group, preferably three of the substituents on the silyl group are acyloxy groups and the fourth substituent is preferably selected from a the group consisting of vinyl or vinyl substituted group, amine or amine substituted group, ureido or ureido substituted group and glycidoxy or glycidoxy substituted group.

In a particularly preferred embodiment, the acyloxy silane is selected from the group consisting of

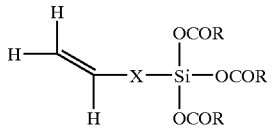

-continued

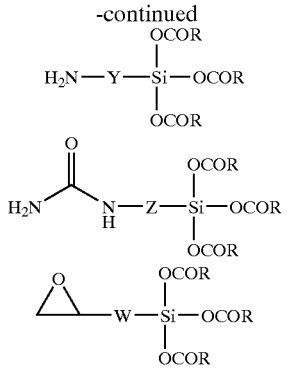

wherein W, X, Y and Z are selected from the group consisting of a C—Si bond, substituted aliphatic groups, unsubstituted aliphatic groups, substituted aromatic groups and unsubstituted aromatic groups, and R is selected from methyl, ethyl and propyl, preferably ethyl.

The acyloxy silane may comprises more than one silyl group. Although the term acyloxy silane generically refers to such a compound, it may be referred to as a multi-silyl-acyloxy silane. More than one multi-silyl-acyloxy silane may be employed in a mixture with one or more other multi-silyl-acyloxy silanes or one or more acyloxy silanes containing a single silyl group as described above.

The acyloxy groups bound to the silicon atoms of the silyl groups of the multi-silyl-acyloxy silane are preferably all the same and are preferably selected from the group consisting of $C_{2-12}$ alkanoyloxy, $C_{3-12}$ alkenoyloxy, $C_{3-12}$ alkynoyloxy and $C_{7-18}$ arenoyloxy, preferably $C_{2-6}$ alkanoyloxy, $C_{3-6}$ alkenoyloxy, $C_{3-6}$ alkynoyloxy and $C_{7-12}$ arenoyloxy. Most preferably the acyloxy groups are all the same and are ethanoyloxy or methanoyloxy groups.

Preferably the multi-silyl-acyloxy silane utilised in the present invention has the structure

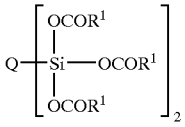

wherein Q is selected from the group consisting of either a bond, an aliphatic or aromatic group; and $R^1$ is selected from methyl, ethyl and propyl.

Preferably Q is selected from the group consisting of a bond, $C_1$–$C_6$ alkylene, $C_2$–$C_6$ alkenylene, $C_1$–$C_6$ alkylene substituted with at least one amino group, $C_2$–$C_6$ alkenylene substituted with at least one amino group, $C_1$–$C_6$ alkylene substituted with at least one sulfide group containing 1 to 6 sulfur atoms, $C_2$–$C_6$ alkenylene substituted with at least one sulfide group containing 1 to 6 sulfur atoms, arylene and alkylarylene. In the case where Q is a bond, the multi-functional silane comprises two trisubstituted silyl groups which are bonded directly to one another. Preferred multi-silyl-acyloxy silane are bis-(triacetoxysilyl)alkane, bis-(triacetoxysilylalkyl)amine and bis-(triacetoxysilylalkyl)tetrasulfide, most preferably bis-(triacetoxysilyl)ethane, bis-(triacetoxysilylpropyl)amine and bis-(triacetoxysilylpropyl) tetrasulfide.

In an especially preferred embodiment, the acyloxy silane utilised in the present invention is vinyltriacetoxysilane.

Acyloxy silanes utilised in the present invention generally dissolve and hydrolyze readily and completely in water to produce organic acids. For example, where an acetoxy silane is used, acetic acid is produced. Unlike the analogous alkoxy silanes commonly utilised in the prior art which produce alcohols upon hydrolysis, the acyloxy silanes utilised in the present invention produce substantially none or small amounts of VOCs depending on the level of non-acyloxy group substitution in the silanes.

Depending on the level of substitution of acyloxy groups in the silanes utilised in the present invention, the pH of the resultant solution can be predetermined and manipulated. Commonly, high degrees of acyloxy group substitution are present, for example ≈100% substitution, and this can result in a pH as low as 1 or 2 At these low levels of pH, the hydrolysed acyloxysilanes tend to condense, therefore reducing their efficacy. It is therefore necessary to add a base to maintain the pH in an optimal range.

Preferably, where a single silyl group-containing silane is used as the acyloxy silane, 3 of the groups attached to the silicon atom of the silyl group are acyloxy groups, preferably methanoyloxy or acetoxy.

Preferably, where a multi-silyl-acyloxy silane is used, 3 of the groups attached to the each silicon atom of each silyl group are acyloxy groups, preferably methanoyloxy or acetoxy.

The pH of the silane mixture is between about 3 and about 10, more preferably between about 4 and about 8, most preferably 4 to 5 and should be maintained. The pH may be adjusted by the addition of one or more basic compounds or addition of acyloxy silane(s).

During preparation of the treatment solution, a pH of above 2, more preferably above 3, most preferably between 4 and 5 should be maintained.

In order to maintain an optimal pH during preparation of the treatment solution, a basic compound is applied to the treatment solution. The identity of the basic compound(s) is not critical but it is highly beneficial to provide a compound which complements the acyloxy silane. "Complements" means that the basic compound aids, or at least does not substantially detract from the formation of ine silane coating on the metal substrate or from the coatings effectiveness in improving corrosion resistance and/or adhesion promotion.

To maintain the pH in tine preferred range, the acyloxy silane and the basic compound are preferably mixed together prior to the addition of water and subsequently dissolved in water. Exemplary basic compounds include the carbonates, hydrogen carbonates and hydroxides of the alkali and alkaline earth metals, organic amines, ammonia, amides and the like. A mixture of different basic compounds may be added to the treatment composition.

In a preferred embodiment, the basic compound is a basic silane compound. For example, amino silanes are particularly preferred. In one embodiment, amino silanes which may be employed in the present invention each have a single trisubstituted silyl group in addition to the basic amine moiety, wherein at least on of the substituents is an alkoxy group. Thus, the amino silanes which maybe used in the present invention have the general structure

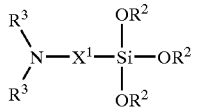

$R^2$ is chosen from the group consisting of hydrogen and $C_1$–$C_{24}$ alkyl, preferably $C_1$–$C_6$ alkyl and each $R^2$ may be the same or different. Preferably $R^2$ is individually chosen from the group consisting of hydrogen, ethyl, methyl, propyl, iso-propyl, butyl, iso-butyl, sec-butyl and ter-butyl.

$X^1$ is a group selected from the group consisting of a bond, a substituted or unsubstituted aliphatic or aromatic group. Preferably $X^1$ is selected from the group consisting of a bond, $C_1$–$C_6$ alkylene, $C_2$–$C_6$ alkenylene, $C_1$–$C_6$ alkylene substituted with at least one amino group, $C_2$–$C_6$ alkenylene substituted with at least one amino group, $C_{6-18}$ arylene and $C_7$–$C_{18}$ alkylarylene; $R^3$ is a group individually selected from the group consisting of hydrogen, $C_1$–$C_6$ alkyl, $C_2$–$C_6$ alkenyl, $C_1$–$C_6$ alkyl substituted with at least one amino group, $C_2$–$C_6$ alkenyl substituted with at least one amino group, arylene and alkylarylene.

Preferably $R^3$ is individually selected from the group consisting of hydrogen, ethyl, methyl, propyl, iso-propyl, butyl, iso-butyl, sec-butyl ter-butyl and acetyl.

Particular preferred amino silanes employed in the method of the present invention are γ-aminopropyltriethoxysilane and γ-aminopropyl trimethoxysilane.

In another embodiment, the amino silane may be a bis-silyl aminosilane(s). Such a compound comprises an aminosilane having two trisubstituted silyl groups, wherein the substituents are individually selected from the group consisting of hydroxy and alkoxy. Preferably, the bis-silyl aminosilane comprises:

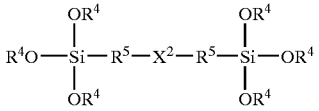

wherein each $R^4$ is individually selected from the group consisting of: hydrogen and $C_1$–$C_2$, alkyl;

each $R^5$ is individually selected from the group consisting of: substituted aliphatic groups, unsubstituted aliphatic groups, substituted aromatic groups, and unsubstituted aromatic groups; and $X^2$ is either.

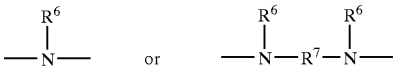

wherein each $R^6$ is individually selected from the group consisting of: hydrogen, substituted and unsubstituted aliphatic groups, and substituted and unsubstituted aromatic groups, and $R^7$ is selected from the group consisting of: substituted and unsubstituted aliphatic groups, and substituted and unsubstituted aromatic groups Particularly preferred bis-silyl aminosilanes which may be used in the present invention include:

bis-(trimethoxysilylpropyl)amine (which is sold under the tradename A-1170 by Witco):

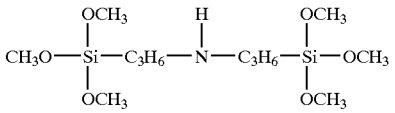

bis-(triethoxysilyipropyl)amine:

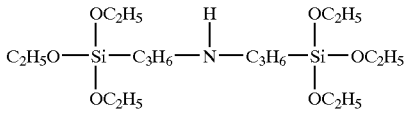

and bis-(triethoxysilylpropyl)ethylene diamine:

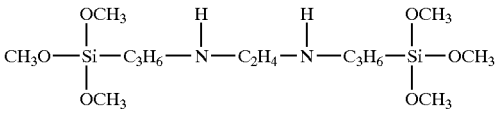

Particularly preferred combinations of acyloxy silanes and basic compounds are:

vinyltriacetoxysilane and bis-(trimethoxysilylpropyl)amine;

1,2-bis-(triethoxysilyl)ethane and bis-(trimethoxysilylpropyl)amine;

vinyltriacetoxysilane and aminopropyltriethoxysilane;

vinyltriacetoxysilane and bis-(triethoxysilylpropyl)amine;

1,2-bis-(triethoxysilyl)ethane and bis-(triethoxysilylpropyl) amine, vinyltriacetoxysilane and aminopropyltrimethoxysilane.

Where basic silanes are used as the basic compound, additional basic compounds may be used, for example, the inorganic bases referred to above.

The solutions and methods of the present invention may be used on a variety of metals, including steel, aluminium, aluminium alloys, zinc, zinc alloys, magnesium, magnesium alloys, copper, copper alloys, tin and tin alloys. In particular, the present method is particularly useful on zinc, zinc alloy, and metals having a zinc-containing coating thereon, as well as aluminium or aluminium containing substrates. For example, the treatment solutions and methods of the present invention are useful in preventing corrosion of steel having a zinc-containing coating, such as: galvanized steel (especially not dipped galvanized steel), GALVALUME® (a 55%-Al/43.4%-Zn/1.6%-Si alloy coated sheet steel manufactured and sold, for example, by Bethlehem Steel Corp), GALFAN® (a 5%-Al/95%-Zn alloy coated sheet steel manufactured and sold by Weirton Steel Corp., of Weirton, WV), galvanneal (annealed hot dipped galvanized steel) and similar types of coated steel. Zinc and zinc alloys are also particularly amenable to application of the treatment solutions and methods of the present invention. Exemplary zinc and zinc alloy materials include: titanium-zinc (zinc which has a very small amount of titanium added thereto), zinc-nickel alloy (typically about 5% to about 13% nickel content), and zinc-cobalt alloy (typically about 1% cobalt).

The solutions of the present invention may be applied to the metal prior to shipment to the end-user, and provide corrosion protection during shipment and storage (including the prevention of wet-storage stain such as white rust). If a paint or other polymer coating is desired, the end user may merely apply the paint or polymer (e.g., such as adhesives, plastics, or rubber coatings) directly on top of the silane coating provided by the present invention. The silane coatings of the present invention not only provide excellent corrosion protection even without paint, but also provide superior adhesion of paint, rubber or other polymer layers. Thus, unlike many of the currently-employed treatment techniques, the silane coatings of the present invention need not be removed prior to painting (or applying other types of polymer coatings such as rubber).

Suitable polymer coatings include various types of paints, adhesives (such as epoxy automotive adhesives), and peroxide-cured rubbers (e.g., peroxide-cured natural, NBR, SBR, nitrile or silicone rubbers). Suitable paints include polyesters, polyurethanes and epoxy-based paints. Plastic coatings are also suitable including acrylic, polyester, polyurethane, polyethylene, polyimide, polyphenylene oxide, polycarbonate, polyamide, epoxy, phenolic, acrylonitrile-butadiene-styrene, and acetal plastics. Thus, not only do the coatings of the present invention prevent corrosion, they may also be employed as primers and/or adhesive coatings for other polymer layers.

The solutions of the present invention do not require the use or addition of silicates.

The compositions may optionally comprise other silane compounds to the acyloxy silanes or the basic silanes disclosed herein.

The treatment solution is aqueous, and may optionally include one or more compatible solvents (such as ethanol, methanol, propanol or isopropanol) although their presence is not normally required. Where an organic solvent is required, ethanol is preferred. Preferably, solutions of the present invention are substantially free of organic solvents and VOCs.

As mentioned above, the silane(s) in the solution of the present invention are at least partially, and preferably are substantially fully hydrolyzed in order to facilitate the bonding of the silanes to the metal surface and to each other. During hydrolysis, the alkoxy groups in the case of the non-acyloxy silanes and the acyloxy in the case of the acyloxy silanes are replaced by hydroxyl groups. Hydrolysis of the silanes may be accomplished, for example, by merely mixing the silanes in water, and optionally including a solvent (such as an alcohol) in order to improve silane solubility and solution stability.

In order to accelerate silane hydrolysis and avoid silane condensation during hydrolysis, the pH may be maintained below about 8, more preferably between about 4 and about 6, and even more preferably between about 4 and about 5.

It should be noted that the various silane concentrations discussed and claimed herein are all defined in terms of the ratio between the amount (by volume) of unhydrolyzed silane(s) employed to prepare the treatment solution (i.e., prior to hydrolyzation), and the total volume of treatment solution components (i.e., acyloxy silanes, basic compound, water, and optional solvents. In the case of acyloxy silane(s), the concentrations herein (unless otherwise specified) refer to the total amount of unhydrolyzed acyloxy silanes employed, since multiple acyloxy silanes may optionally be present. The basic compounds concentrations herein are defined in the same manner.

As for the concentration of hydrolyzed silanes in the treatment solution, beneficial results will be obtained over a wide range of silane concentrations and ratios. It is preferred, however, that the solution have at least about 0.1% acyloxy silanes by volume, more preferably at least about 1% acyloxy silanes by volume, most preferably between about 2% and about 5% by volume. Lower vinyl silane concentrations generally provide less corrosion protection. Higher concentrations of acyloxy silanes (greater than about 10%) should also be avoided for economic reasons, and to avoid silane condensation (which may limit storage stability).

The concentration of the basic compound required in the treatment solution varies strongly with the type of acyloxy silane employed and the type of basic compound. Obviously, a strongly acidic solution produced by a highly acyloxy group-substituted acyloxy silane will require an appropriate amount of basic compound to result in a treatment solution with a pH in the pre-determined range. Once the pH of the acyloxy silane in solution is known, an appropriate amount of a basic compound (with a known pH value in solution) can be added to the solution. The relative acidity and basicity of the acyloxy silane and the basic compound may be established before the solution is made up and are commonly presented in standard tables reciting physical properties of known compounds. However, the concentration of the basic compound is generally in the range of about 0.1% and about 10% by volume.

Where a basic silane is used as the basic compound, the solution should have at least about 0.1% basic silanes by volume, more preferably at least about 1% basic silane by volume, more preferably between about 2% and about 10%, most preferably between about 2% and about 5% by volume.

As for the ratio of acyloxy silanes to basic compound, a wide range of ratios may be employed, and the present invention is not limited to any particular range of silane ratios.

The mixture of the acyloxy and basic compound may be provided to the user in a pre-mixed, unhydrolysed form which improves shelf life as condensation of the silane is limited. Such a mixture can then be made up into a treatment solution as defined herein. Such a pre-mixed, unhydrolysed compositions should preferably be substantially free of water but may include one or more organic solvents (such as alcohols). The composition may also include other components such as stabilizers, pigments, desiccants, and the like.

Such a pre-mixed composition can be made up with a pre-determined amount of acyloxy silane and basic compound so that the addition of the mixture to water results in a pH within the preferred range. Such pre-mixing prevents or limits a drop in pH, due to the acyloxy silane alone being present in solution, to levels which promote condensation of the silanes in solution. However, the composition can be presented in a "two-pacK" kit, wherein one part of the kit comprises the acyloxy silane, while another part of the kit provides the basic compound.

In either of the above presentation embodiments, the acyloxy silane and basic compound, along with the other components of the composition are provided in a concentrated form as a powder or liquid mixture. In either case, the concentrate is substantially free of water and may be presented in a hermetically sealed container or kit. Preferably, substantially no organic solvent is present in the composition.

The concentration of the acyloxy silane and basic compound in the pre-mixed concentrate composition is generally in the range 10–100%, preferably 15–80%, most preferably 25–70%. The concentrate may contain numerous additional components such as stabilisers, pigments, anti-oxidants, basic pH adjusters, desiccants, adhesion promoters, corrosion inhibitors and the like.

The treatment method itself is very simple. Where the solution is to be made up of separately presented components, the unhydrolyzed acyloxy silane, water, basic compound, solvent (if desired), are combined with one another. The solution is then stirred at room temperature in order to hydrolyze the silanes. The solution generally goes clear when hydrolysis is complete. In this embodiment it is beneficial to maintain the pH of the solution above 2 to limit any condensation of the silanes in solution, particularly the acyloxy silanes.

Where the composition is presented as a pre-mixed kit, the composition is simply added to a predetermined amount of water and mixed until the solution is substantially clear.

The metal surface to be coated with the solution of the present invention may be solvent and/or alkaline cleaned by techniques well-known to those skilled in the art prior to application of the treatment solution of the present invention. The silane solution is then applied to the metal surface (i.e., the sheet is coated with the silane solution) by, for example, dipping the metal into the solution (also referred to as "rinsing") spraying the solution onto the surface of the metal, or even brushing or wiping the solution onto the metal surface. Various other application techniques well-Known to those skilled in the art may also be used. When the preferred application method of dipping is employed, the duration of dipping is not critical, as it generally does not significantly affect the resulting film thickness. It is merely preferred that whatever application method is used, the contact time should be sufficient to ensure complete coating of the metal. For most methods of application, a contact time of at least about 2 seconds, and more preferably at least about 5 seconds, will help to ensure complete coating of the metal.

As the treatment solution is used up, the acyloxy silane concentration is reduced and the acetic acid concentration remains approximately constant as long as no further acyloxy silane is added to the solution. As further acyloxy silane is added to maintain their concentration, acetic acid is built up in the solution. To maintain the pH in the preferred range pH adjusters may be added such as basic compounds as hereinbefore described, buffers and the like. In one embodiment, a basic compound may be added along with the additional acyloxy silane which forms a salt with the acid in solution. This may form an insoluble salt which can be removed from the process.

The treatment solution may also be heated when applying the treatment solution. Where the treatment solution is heated, the temperature of the treatment solution is generally in the range 20° C. to 80° C., preferably 30° C. to 50° C.

After coating with the treatment solution of the present invention, the metal sheet may be air-dried at room temperature, or, more preferably, placed into an oven for heat drying. Preferable heated drying conditions include temperatures between about 20° C. and about 200° C. with drying times of between about 30 seconds and about 60 minutes (higher temperatures allow for shorter drying times) More preferably, heated drying is performed at a temperature of at least about 90° C., for a time sufficient to allow the silane coating to dry. While heated drying is not necessary to achieve satisfactory results, it will reduce the drying time thereby lessening the likelihood of the formation of white rust during drying. Once dried, the treated metal may be shipped to an end-user, or stored for later use.

The examples below demonstrate some of the superior and unexpected results obtained by employing the methods of the present invention.

EXAMPLES

Example 1

Salt Spray test (SST)(Lakebluff) was carried out on A1170/Vinyltriacetoxysilane (1/1, 5%, natural pH=4) treated AA5005 panels. Alkaline cleaned blank and chromated AA5005 panels were chosen as controls. The treated panels were cured at 100° C. for 10 min, and then exposed to SST for 29 days, along with the control panels. Four replicates were made for each treatment. The results are presented in FIG. 1.

1 A1170/VTAS treated panels snowed original surface after 29 days of exposure to SST, i.e. no corrosion occurred during testing.

2. The blank panels corroded heavily, while the chramated ones pitted apparently.

Example 2

Salt Spray test (Lakebluff) was carried out on A1170/VTAS (1.5/1.5%, natural pH=4) treated A12024-T3 panels. Alkaline cleaned blank and chromated A12024-T3 panels were chosen as controls. The treated panels were cured at 100° C. for 10 min. and then exposed to SST for 7 days, along with the control panels. Three replicates were made for each treatment. The results are presented in FIG. 2.

3. A1170/VTAS treated panels showed almost original surface after 7 days of exposure to SST, i.e, only slight edge corrosion occurred during testing.

4. The blank panels corroded heavily, while the chromated ones pitted slightly.

Example 3

In order to investigate the paintability of A1170/VTAS water-based silane film on metal substrates, A1170/VTAS (1.5/1.2%, pH=5) water-based silane film was applied on A12023-T3 and HDG, respectively. The treated panels were then powder-painted at Lakebluff with Polyester and Polyurethane powder paints. After that, the panels were put into salt spray chamber for some times, along with the control panels, the blank and the chromated. Three replicates were made for each treatment. The results are shown in FIG. 3.

1. As for A12024-T3 painted with both powder paints (1000 hrs in SST), the corrosion performance and paint adhesion improved significantly, which was equal to the chromated and much better than the blank.

2. As for powder-painted HDG (336 hrs in SST), the corrosion performance improved apparently, compared with the chromated and the blank. The paint adhesion improved somewhat, which was better that the control panels

What is claimed is:

1. A method of treating a metal surface, comprising the steps of:

(a) providing a metal substrate; and (b) applying an aqueous solution to said metal substrate, said solution comprising:

(i) at least one acyloxy silane, wherein said acyloxy silane comprises at least one acyloxy group, and wherein said acyloxy silane has been at least partially hydrolysed and is either (A) a single tetrasubstituted silicon atom wherein the substituents are individually selected from the group consisting of alkyl, alkenyl, alkynyl, aryl, alkaryl, aralkyl, vinyl, amino, ureido, glycidoxy, epoxy, hydroxy, alkoxy, aryloxy, acyloxy, and any of the group alkyl, alkenyl, alkynyl, aryl, alkaryl and aralkyl substituted by a group selected from the group consisting of vinyl, amine, ureido, glycidoxy, epoxy, hydroxy and alkoxy, with the proviso that at least one of the substituents on the silicon atom is an acyloxy group; or (B) a multisilyl acyloxy silane; and (ii) at least one basic silane compound which is selected from the group consisting of (A) compounds having the general structure

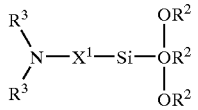

wherein $R^2$ is chosen from the group consisting of hydrogen and $C_1$–$C_{24}$ alkyl, and each $R^2$ may be the same or different; $X^1$ is selected from the group consisting of a bond, substituted and unsubstituted aliphatic groups and substituted and unsubstituted aromatic groups; and $R^3$ is a group individually selected from the group consisting of hydrogen, $C_1$–$C_6$ alkyl, $C_2$–$C_6$ alkenyl, $C_1$–$C_6$ alkyl substituted with at least one amino group, $C_2$–$C_6$ alkenyl substituted with at least one amino group, arylene and alkylarylene; and (B) a bis-silyl aminosilane(s) having the structure

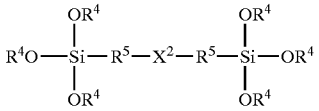

wherein $R^4$ is individually selected from the group consisting of: hydrogen and $C_1$–$C_{24}$ alkyl;

$R^5$ is individually selected from the group consisting of: substituted aliphatic groups, unsubstituted aliphatic groups, substituted aromatic groups, and unsubstituted aromatic groups; and —$X^2$ is either:

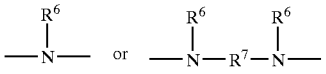

wherein each $R^6$ is individually selected from the group consisting of: hydrogen, substituted and unsubstituted aliphatic groups, and substituted and unsubstituted aromatic groups; and $R^7$ is selected from the group consisting of: substituted and unsubstituted aliphatic groups, and substituted and unsubstituted aromatic groups wherein the acyloxy silane and the basic silane compound are present in concentrations to provide a solution pH of between 3 and 10 and wherein the solution is substantially free of acid other than acid produced upon hydrolysis of the acyloxy silane.

2. The method of claim 1, wherein $R^2$ is $C_1$–$C_6$ alkyl.

3. The method of claim 1, wherein the solution pH is between 4 and 8.

4. The method of claim 1, wherein the solution pH is between 4 and 5.

5. The method of claim 1, wherein the metal surface is selected from the group consisting of steel, aluminum, aluminum alloys, zinc, zinc alloys, magnesium, magnesium alloys, copper, copper alloys, tin and tin alloys.

6. The method of claim 1, wherein the metal surface is selected from the group consisting of:

a metal surface having a zinc-containing coating;

zinc;

zinc alloy;

Aluminum;

Aluminum alloy; and steel.

7. The method of claim 1, wherein the acyloxy silane comprises one silyl group.

8. The method of claim 1, wherein the acyloxy silane comprises more than one silyl group.

9. The method of claim 1, wherein the acyloxy silane comprises two silyl groups.

10. The method of claim 1, wherein each acyloxy group on the at least one acyloxy silane is the same and is selected from the group consisting of $C_{2-12}$ alkanoyloxy, $C_{3-12}$ alkenoyloxy, $C_{3-12}$ alkynoyloxy and $C_{7-18}$ arenoyloxy.

11. The method of claim 10, wherein each acyloxy group is selected from the group consisting of $C_{2-6}$ alkanoyloxy, $C_{3-6}$ alkenoyloxy, $C_{3-6}$ alkynoyloxy and $C_{7-12}$ arenoyloxy.

12. The method of claim 11, wherein each acyloxy group is ethanoyloxy or methanoyloxy group.

13. The method of claim 1, wherein the acyloxy silane is selected from the group consisting of:

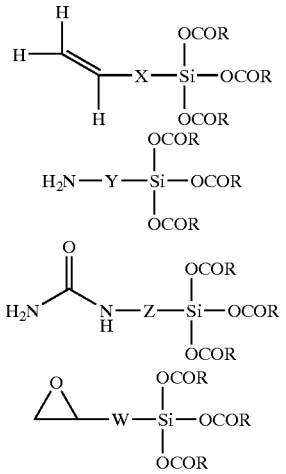

wherein W, X, Y and Z are selected from the group consisting of a C—Si bond, substituted aliphatic groups, unsubstituted aliphatic groups, substituted aromatic groups and unsubstituted aromatic groups; and R is selected from methyl, ethyl and propyl.

14. The method of claim 13, wherein R is ethyl.

15. The method of claim 8, wherein the acyloxy silane has the structure

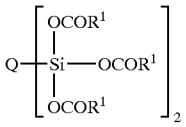

wherein Q is selected from the group consisting of a bond, an aliphatic group and an aromatic group; and $R^1$ is selected from methyl, ethyl and propyl.

16. The method of claim 15, wherein Q is selected from the group consisting of a bond, $C_1$–$C_6$ alkylene, $C_2$–$C_6$ alkenylene, $C_1$–$C_6$ alkylene substituted with at least one amino group, $C_2$–$C_6$ alkenylene substituted with at least one amino group, $C_1$–$C_6$ alkylene substituted with at least one sulfide group containing 1 to 10 sulfur atoms, $C_2$–$C_6$ alkenylene substituted with at least one sulfide group containing 1 to 10 sulfur atoms, arylene and alkylarylene.

17. The method of claim 16, wherein the acyloxy silane is selected from the group consisting of bis-(triacetoxysilyl) ethane, bis-(triacetoxysilylpropyl) amine and bis(triacetoxysilylpropyl)tetrasulfide.

18. The method of claim 1, wherein the acyloxy silane is vinyltriacetoxysilane.

19. The method of claim 1, wherein $R^2$ is individually chosen from the group consisting of hydrogen, ethyl, methyl, propyl, iso-propyl, butyl, iso-butyl, sec-butyl and ter-butyl;

$X^1$ is selected from the group chosen from the group consisting of a bond, $C_1$–$C_6$ alkylene, $C_2$–$C_6$ alkenylene, $C_1$–$C_6$ alkylene substituted with at least one amino group, $C_2$–$C_6$ alkenylene substituted with at least one amino group, arylene and alkylarylene; and $R^3$ is individually selected from the group consisting of hydrogen, ethyl, methyl, propyl, isopropyl, butyl, isobutyl, sec-butyl and ter-butyl.

20. The method of claim 1, wherein the basic silane compounds are selected from the group consisting of γ-aminopropyltriethoxysilane and γ-aminopropyltrimethoxysilane, bis-(trimethoxysilylpropyl)amine, bis-(triethoxysilylpropyl)amine and bis-(triethoxysilylpropyl)ethylene diamine.

21. The method of claim 1, wherein a polymer coating is applied to the treated metal substrate.

22. The method of claim 1, wherein the polymer coating is selected from paints, adhesives, rubbers and plastics.

23. The method of claim 1, wherein the solution contains at least 0.1% acyloxy silanes by volume.

24. The method of claim 1, wherein the solution contains at least 1% acyloxy silanes by volume.

25. The method of claim 1, wherein the solution contains between 2% and 5% by volume of acyloxy silanes.

26. The method of claim 1, wherein the solution contains at least 0.1% basic silane compound by volume.

27. The method of claim 1, wherein the solution contains at least 1% by volume of basic silane compound.

28. The method of claim 1, wherein the solution contains between 2% and 5% of basic silane compound.

29. An aqueous solution comprising an acyloxy silane and a basic silane compound of claim 1, wherein the acyloxysilane and the basic silane compound are present in concentrations to provide a solution pH of between 3 and 10 and wherein the solution is substantially free of acid other than the acid produced upon hydrolysis of the acyloxy silane.

30. The aqueous solution of claim 29, wherein the aqueous solution pH is between 4 and 8.

31. The aqueous solution of claim 29, wherein the aqueous solution pH is between 4 and 5.

32. The aqueous solution of claim 29, wherein the solution contains at least 0.1% acyloxy silanes by volume.

33. The aqueous solution of claim 29, wherein the solution contains at least 1% acyloxy silanes by volume.

34. The aqueous solution of claim 29, wherein the solution contains between 2% and 5% of acyloxy silanes by volume.

35. The aqueous solution of claim 29, wherein the aqueous solution contains at least 0.1% basic silane compound by volume.

36. The aqueous solution of claim 29, wherein the solution contains at least 1% by volume of basic silane compound.

37. The aqueous solution of claim 29, wherein the solution contains between 2 and 10% by volume of basic silane compound.

38. The aqueous solution of claim 29, wherein the solution contains between 2% and 5% by volume of basic silane compound.

* * * * *